US005765281A

United States Patent [19]

Abe et al.

[11] Patent Number: 5,765,281

[45] Date of Patent: Jun. 16, 1998

[54] PRESS-CONNECTING CONNECTOR AND METHOD OF PRODUCING SAME

[75] Inventors: Kimihiro Abe; Hiroshi Yamamoto, both of Shizuoka, Japan

[73] Assignee: Yazaki Corporation, Tokyo, Japan

[21] Appl. No.: 664,617

[22] Filed: Jun. 18, 1996

[30] Foreign Application Priority Data

Jun. 19, 1995 [JP] Japan ..... 7-151800

[51] Int. Cl.[6] ..... H01R 43/00

[52] U.S. Cl. ..... 29/858; 29/860

[58] Field of Search ..... 29/857, 858, 860; 439/937

[56] References Cited

U.S. PATENT DOCUMENTS 4,202,091 5/1980 Ohnishi ..... 29/858
4,655,515 4/1987 Hamsher, Jr. et al. ..... 29/858

FOREIGN PATENT DOCUMENTS 1-137091 9/1989 Japan ..... H01R 43/01

*Primary Examiner*—W. Donald Bray
*Attorney, Agent, or Firm*—Sughrue, Mion, Zinn, Macpeak & Seas, PLLC

[57] ABSTRACT

A method of producing a press-connecting connector, in which even if the insert molding is effected by pouring a non-electrically conductive material while supporting press-connecting terminals by a fixing pin within a mold, an exposed portion, resulting from the trace of the fixing pin, is covered with the non-electrically conductive material. In the press-connecting connector, press-connecting terminals for press-connecting sheathed wires are positioned by a fixing pin provided in a mold, and are insert-molded in a non-electrically conductive material. An exposed portion, formed by the fixing pin at the bottom of the press-connecting terminals, is closed by pressing and fusing a plurality of hole closure pieces, molded at the same time, together. Therefore, the efficiency of the operation is enhanced, and also the production cost can be reduced, and the highly-reliable press-connecting connector can be obtained.

8 Claims, 6 Drawing Sheets

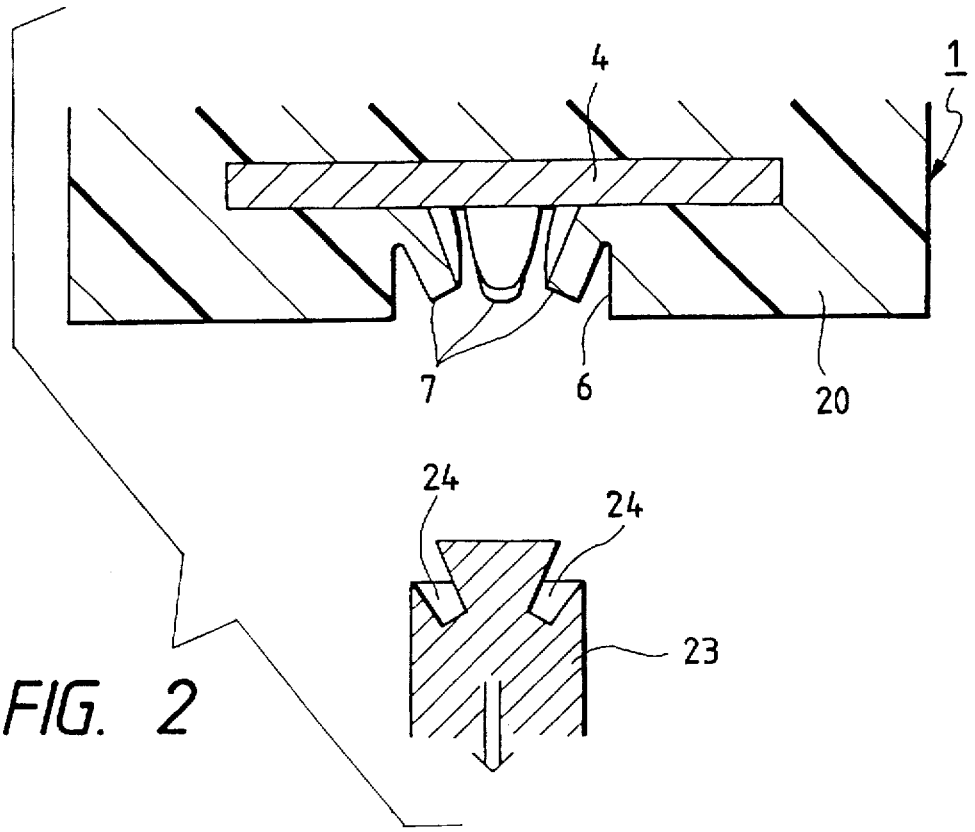
FIG. 2
FIG. 3
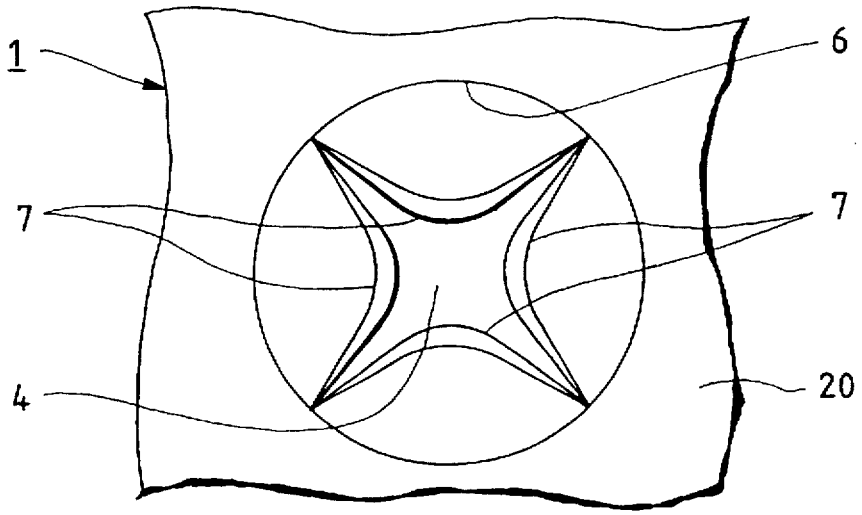

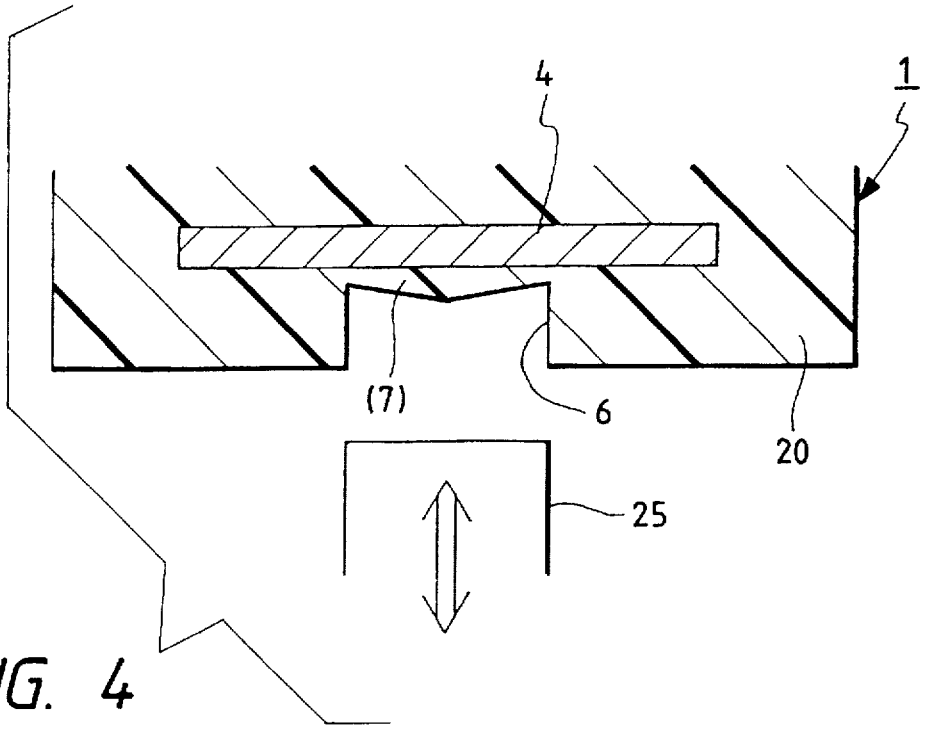
FIG. 4
FIG. 6
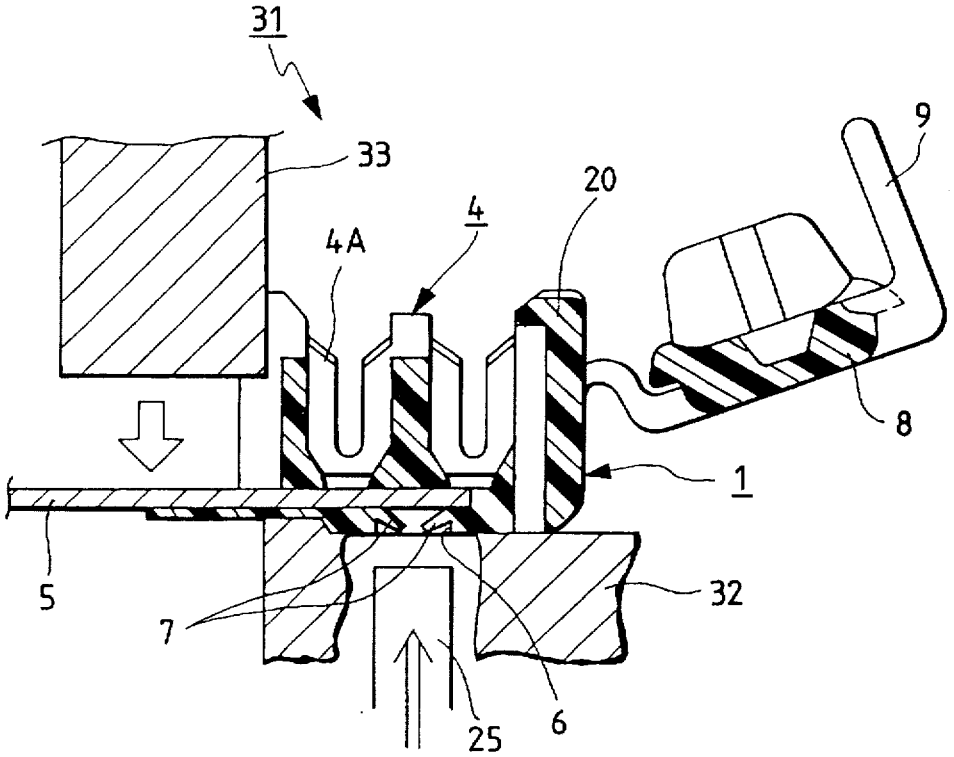

PRESS-CONNECTING CONNECTOR AND METHOD OF PRODUCING SAME

BACKGROUND OF THE INVENTION

1. Field of the Invention

This invention relates to a press-connecting connector having press-connecting terminals (for electrically press-connecting a plurality of wires together) insert-molded in a non-electrically conductive material, and also relates to a method of producing such a connector.

2. Background

Various press-connecting connectors, as well as methods of producing such a connector, have heretofore been proposed, and for example, Unexamined Japanese Utility Model Publication No. 1-137091 discloses one such connector and method.

SUMMARY OF THE INVENTION

It is an object of this invention to provide a press-connecting connector in which even if the insert molding is effected by pouring a non-electrically conductive material while supporting press-connecting terminals by a fixing pin within a mold, an exposed portion, resulting from the trace of the fixing pin, is covered with the non-electrically conductive material. Another object of the invention is to provide a method of producing such a press-connecting connector.

The above object of the invention has been achieved by a method of producing a press-connecting connector in which a plurality of groups of press-connecting terminals are formed in a branched manner on a linkage plate, having a series of feed perforations, through respective connecting portions, and each group of press-connecting terminals are positioned in a mold by a fixing pin which supports the press-connecting terminals, and in this condition the press-connecting terminals are insert-molded in a non-electrically conductive material, in which a plurality of hole closure pieces, molded by the fixing pin during the molding operation, are pressed toward the press-connecting terminals and fused together by a hole closure pin at a later step to close an exposed portion resulting from a trace of the fixing pin.

The closing of the exposed portion by the pressing of the hole closure pin can be effected in a wire press-connecting step carried out after the insert-molding operation.

The closing of the exposed portion by the pressing of the hole closure pin can be effected in a connecting portion-cutting step carried out after the insert-molding operation.

The hole closure pieces can be molded by a hole closure piece-forming mold formed on the fixing pin.

The above object has been achieved by a press-connecting connector in which press-connecting terminals for press-connecting sheathed wires are positioned by a fixing pin provided in a mold, and are insert-molded in a non-electrically conductive material, in which an exposed portion, formed by the fixing pin at a bottom of the press-connecting terminals, is closed by pressing and fusing a plurality of hole closure pieces, molded at the same time, together.

In the press-connecting connector and the method of producing the same, the plurality of groups of press-connecting terminals are formed in a branched manner on the linkage plate, having a series of feed perforations, through respective connecting portions, and each group of press-connecting terminals are positioned in the mold by the fixing pin which supports the press-connecting terminals, and in this condition the press-connecting terminals are insert-molded in the non-electrically conductive material, thereby producing the press-connecting connector. The plurality of hole closure pieces, molded by the fixing pin during the molding operation, are pressed toward the press-connecting terminals and fused together by the hole closure pin at a later step to close the exposed portion resulting from the trace of the fixing pin. Thus, the present invention prevents the press-connecting terminals of the press-connecting connector from contacting a metal portion of a car such as a car body, which causes short-circuiting. Therefore, the reliability of the press-connecting connector is enhanced.

Where the closing of the exposed portion by the pressing of the hole closure pin is effected in the wire press-connecting step carried out after the insert-molding operation, it is not necessary to provide a separate step of pressing the hole closure pin, and therefore the efficiency of the operation is enhanced, and also the cost can be reduced.

Where the closing of the exposed portion by the pressing of the hole closure pin is effected in the connecting portion-cutting step carried out after the insert-molding operation, it is not necessary to provide a separate step of pressing the hole closure pin as in the above case, and therefore the efficiency of the operation is enhanced, and also the cost can be reduced.

Where the hole closure pieces are molded by the hole closure piece-forming mold formed on the fixing pin, it is not necessary to provide a separate step of forming a closure portion for closing the exposed portion, and another separate step of pressing this closure portion, and therefore the cost can be reduced. And besides, since the exposed portion can be easily closed by pressing the hole closure pieces by the hole closure pin, the efficiency of the operation is enhanced.

In the press-connecting connector in which the press-connecting terminals for press-connecting sheathed wires are positioned by the fixing pin provided in the mold, and are insert-molded in the non-electrically conductive material, the exposed portion, formed by the fixing pin at the bottom of the press-connecting terminals, is closed by pressing and fusing the plurality of hole closure pieces, molded at the same time, together. Therefore, the present invention eliminates the problem that the press-connecting terminals contact the metal portion of the car such as the car body, thereby causing short-circuiting. Therefore, the highly-reliable press-connecting connector can be obtained.

BRIEF DESCRIPTION OF THE DRAWINGS

FIG. 2 is a cross-sectional view of a portion including hole closure pieces of FIG. 1;

FIG. 3 is an enlarged bottom view showing the hole closure pieces of FIG. 2;

FIG. 4 is a cross-sectional view showing a condition in which the bottom of a press-connecting terminal in FIG. 2 is closed;

FIG. 6 is a view showing a connecting portion-cutting step in the invention;

DETAILED DESCRIPTION OF THE PREFERRED EMBODIMENTS

Preferred embodiments of a press-connecting connector of the present invention, as well as a method of producing the connector, will now be described in detail with reference to FIGS. 1 to 8.

Figure 1:
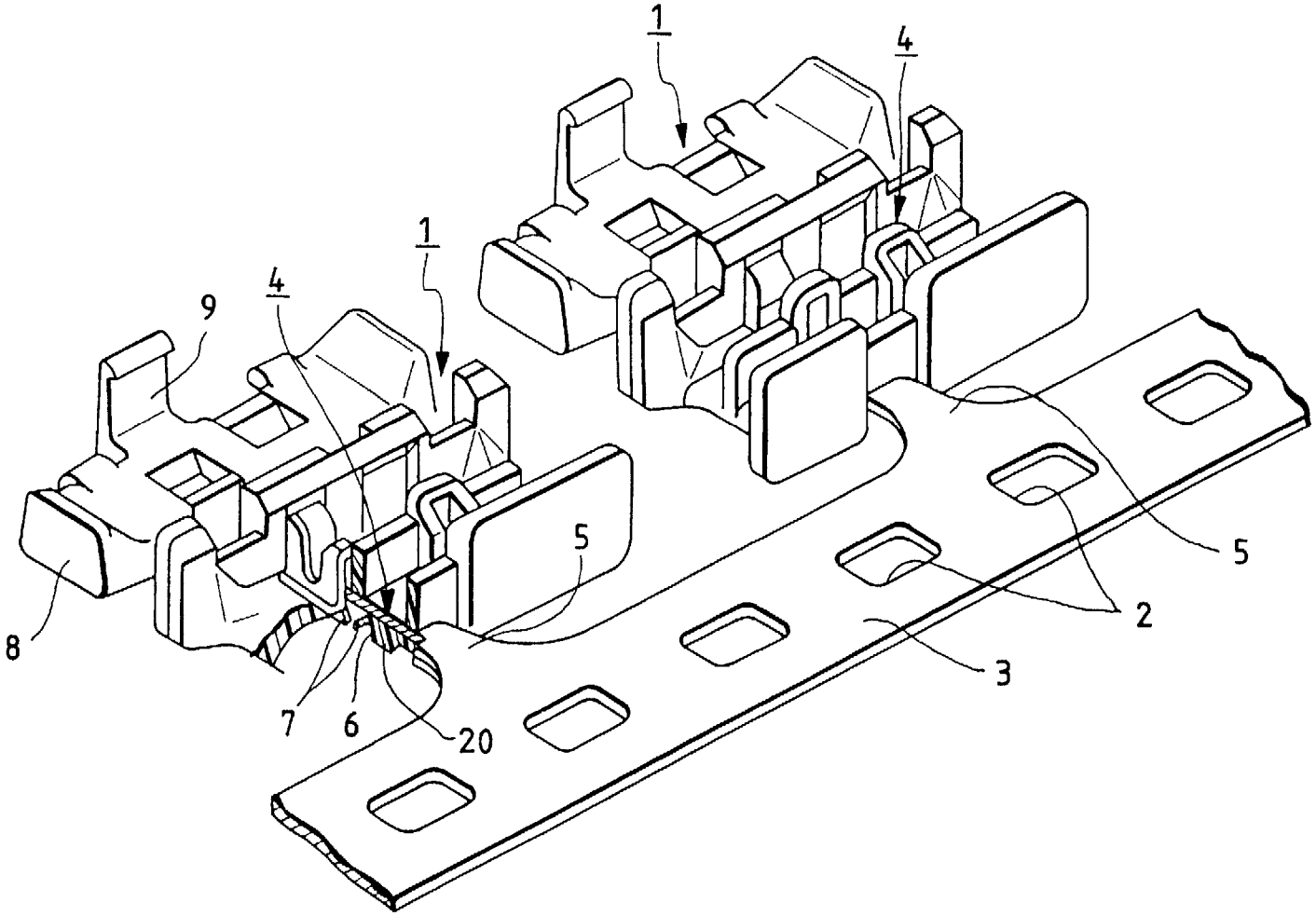
FIG. 1 is a perspective view showing a preferred embodiment of a press-connecting connector production method of the invention.
Figure 5:
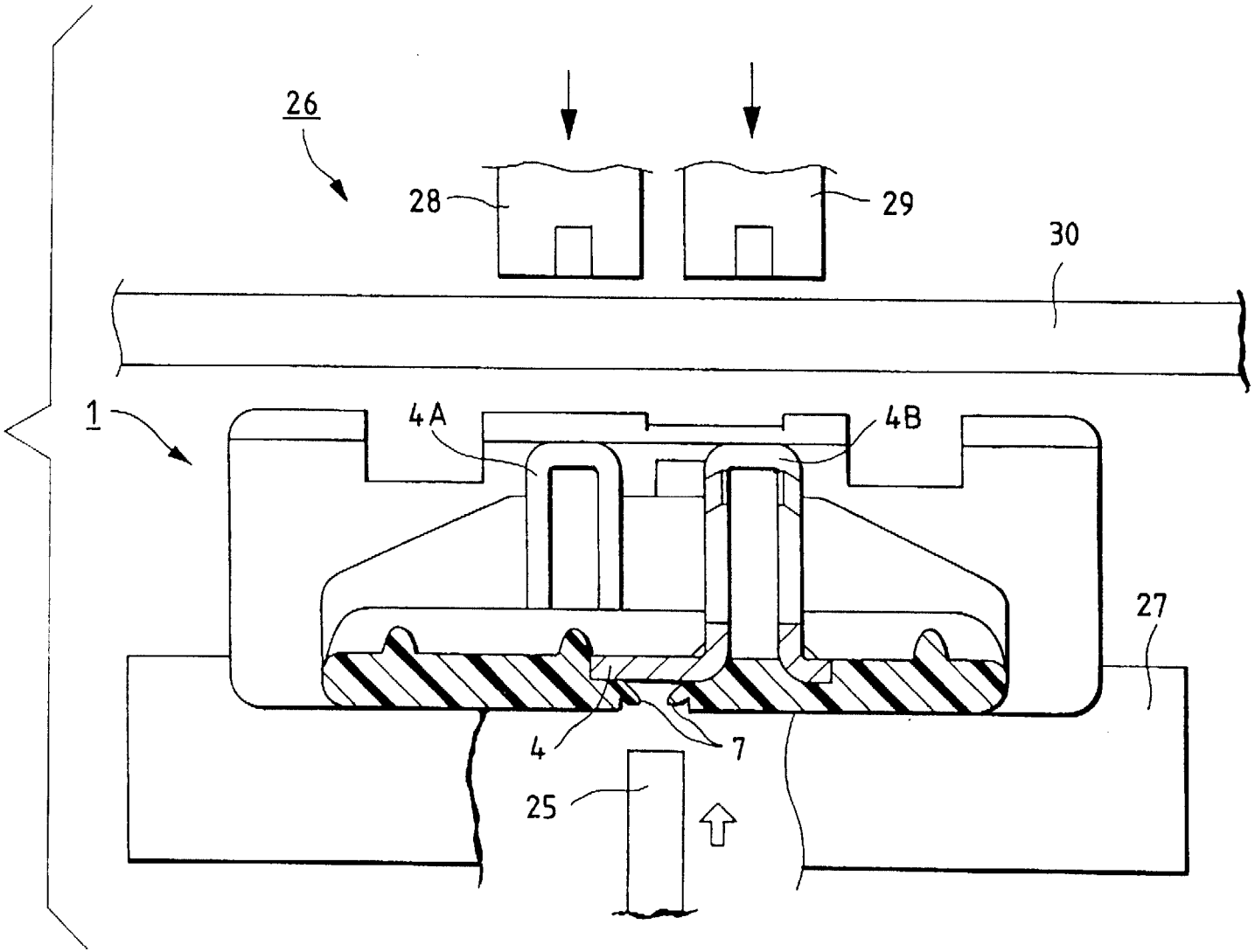
FIG. 5 is a view showing a wire press-connecting step in the invention.
Figure 7:
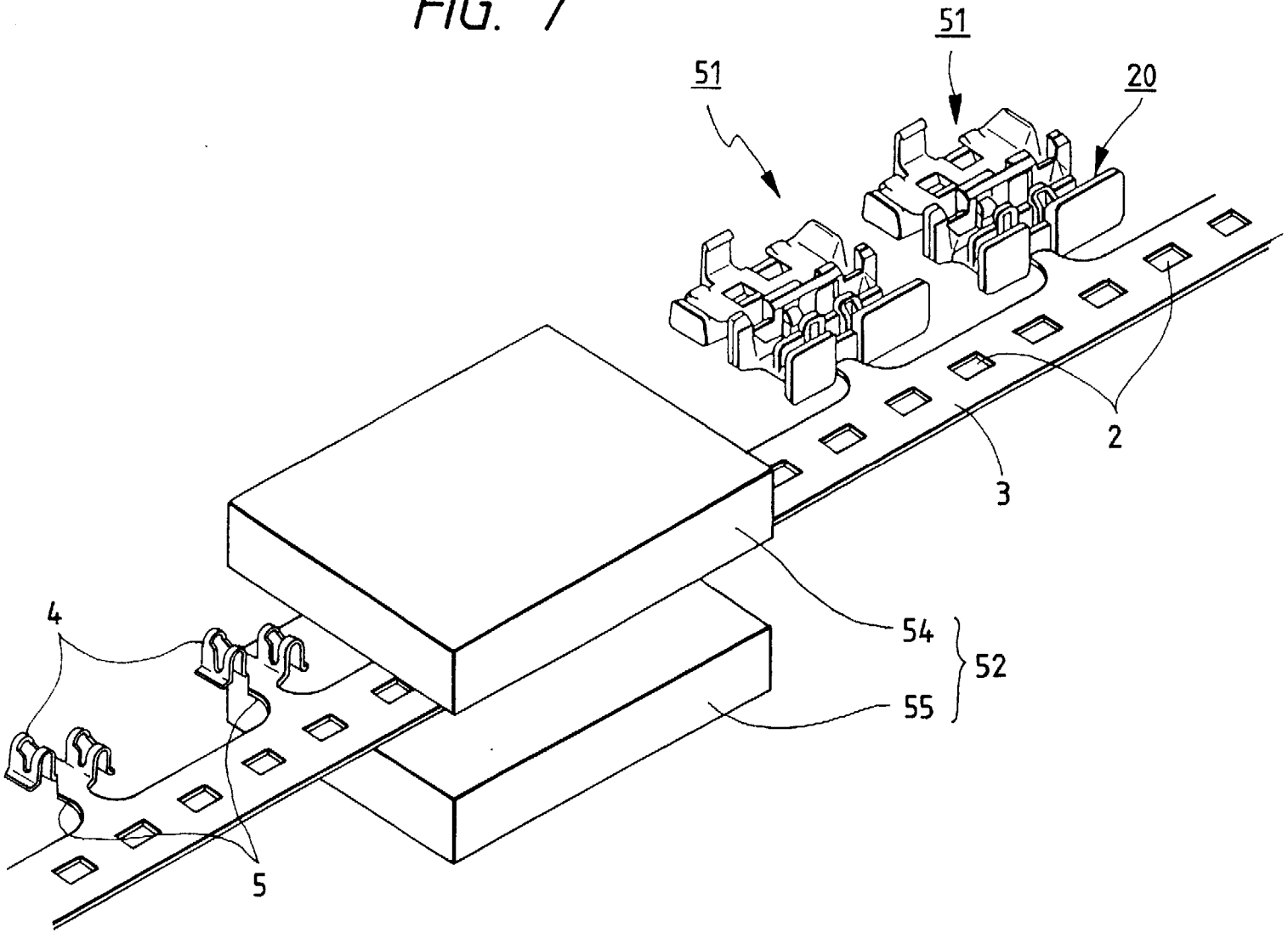
FIG. 7 is a perspective view illustrating a preliminary embodiment of a press-connecting connector production method of the invention.
Figure 8:
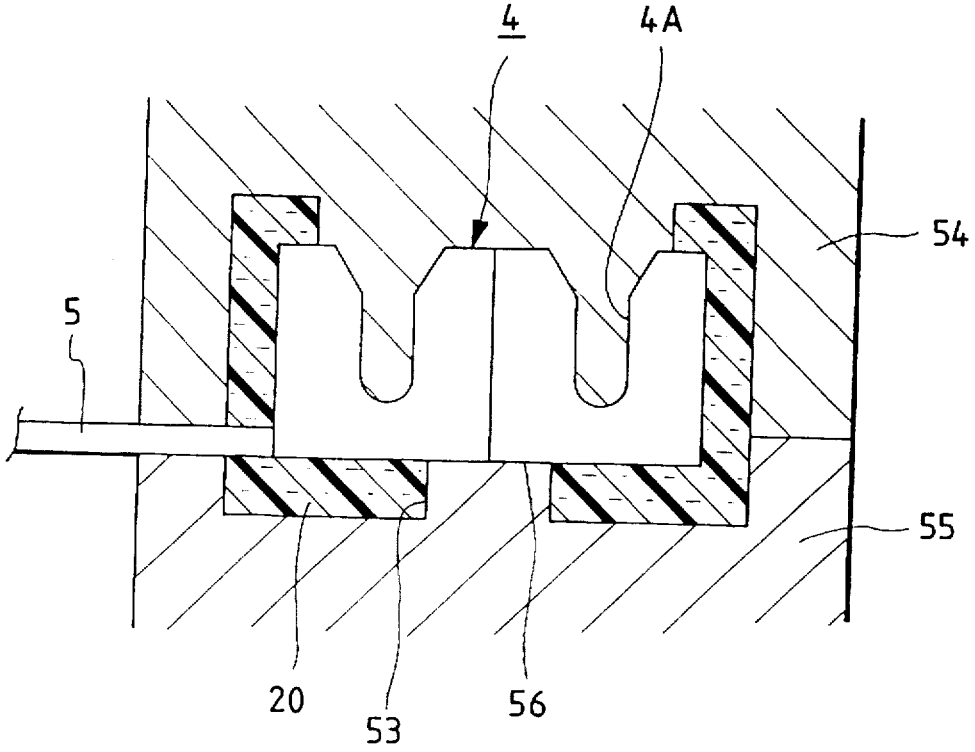
FIG. 8 is a cross-sectional view of a mold used in the method of FIG. 7.

FIG. 1 is a perspective view showing the press-connecting connector production method of the invention, FIG. 2 is a cross-sectional view of a portion including hole closure pieces of FIG. 1, FIG. 3 is an enlarged bottom view showing the hole closure pieces of FIG. 2, FIG. 4 is a cross-sectional view showing a condition in which the bottom of a press-connecting terminal in FIG. 2 is closed, FIG. 5 is a view showing a wire press-connecting step in the invention, FIG. 6 is a cross-sectional view showing a connecting portion-cutting step in the invention, FIG. 7 is a perspective view illustrating a preliminary embodiment of a press-connecting connector production method of the invention, and FIG. 8 is a cross-sectional view of a mold used in the method of FIG. 7.

First, a preliminary embodiment of the present invention will now be illustrated with reference to FIGS. 7 and 8. As shown in FIGS. 7 and 8, in the press-connecting connector 51, a plurality of groups of press-connecting terminals 4 are formed in a branched manner on a linkage plate 3 (which is in the form of a metal plate), having a series of feed holes or perforations 2, through respective connecting portions 5, and each group of press-connecting terminals 4 are positioned in a mold 52 by a fixing pin 53 which supports the press-connecting terminals 4, and in this condition the press-connecting terminals 4 are insert-molded in a non-electrically conductive material 20 such as a synthetic resin.

The mold 52 includes a pair of upper and lower molds 54 and 55 as shown in FIG. 8, and the fixing pin 53 is formed on the lower mol d 55. Therefore, when the press-connecting terminals 4 are insert-molded by pouring the non-electrically conductive material 20 into the mold 52, the trace of the fixing pin 53 remains as an exposed portion 56, so that the bottom of the press-connecting terminals 4 are exposed to the exterior.

However, the press-connecting connectors 51 are connected to the linkage plate 3 (in the form of a metal plate) by the respective connecting portions 5, and are accurately fed by the feed perforations 2 to a subsequent step, and therefore the press-connecting connectors can be processed in a highly reliable manner. And besides, the press-connecting terminals 4 have already been insert-molded in the press-connecting connector 51, the step of inserting the press-connecting terminals 4 is not necessary. Therefore, the efficiency of the operation is enhanced.

After the step of insert-molding the press-connecting terminals 4, a wire press-connecting step (in which a plurality of wires are press-connected to the terminals by a wire press-connecting device) and a connecting portion-cutting step (in which the connecting portion 5 is cut off by a connecting portion-cutting device so as to separate the plurality of interconnected press-connecting connectors 51 from one another) are carried out.

In view of the above, as shown in FIGS. 1 to 4, in the press-connecting connector 1, a plurality of groups of press-connecting terminals 4 are formed in a branched manner on a linkage plate 3 (which is in the form of a metal plate), having a series of feed holes or perforations 2, through respective connecting portions 5, and each group of press-connecting terminals 4 are positioned in a mold (not shown) by a fixing pin 23 which supports the press-connecting terminals 4, and in this condition the press-connecting terminals 4 are insert-molded in a non-electrically conductive material 20 such as a synthetic resin.

The fixing pin 23 is formed on a lower mold, and therefore when the press-connecting terminals 4 are insert-molded by pouring the non-electrically conductive material 20 into the mold, the trace of the fixing pin 23 remains as an exposed portion 6, so that the bottom of the press-connecting terminals 4 are exposed to the exterior.

However, since a hole closure piece-forming mold 24 for molding a plurality of hole closure pieces 7 for closing the exposed portion 6 is formed on the fixing pin 23, the bottom of the press-connecting terminals 4 are not completely exposed after the molding. As shown in FIG. 3, the hole closure pieces 7 are defined respectively by a plurality of sections into which a generally conical, thin wall is divided by radially-extending slits.

Therefore, when the plurality of hole closure pieces 7 are pressed toward the press-connecting terminals 4 by a hole closure pin 25 as shown in FIG. 4 before the molded, non-electrically conductive material 20 is sufficiently hardened, the plurality of hole closure pieces 7 are pressed and fused together at the slits to form an integral plate to close the bottom of the press-connecting terminals 4.

Therefore, the press-connecting terminal 4 does not contact a metal portion of a car, such as a car body, through the exposed portion 6, thereby causing short-circuiting. Therefore, the reliability of the press-connecting connector is enhanced.

The step of pressing and fusing the hole closure pieces 7 by the hole closure pin 25 does not need to be carried out independently, but this step can be carried out simultaneously with the wire press-connecting step or the connecting portion-cutting step, as shown in FIGS. 5 and 6. By doing so, the efficiency of the operation is enhanced, and the cost can be reduced.

In FIG. 5, the press-connecting connector 1 is placed on a base 27 of a wire press-connecting device 26, and then when each of a plurality of sheathed wires 30 is pressed toward the press-connecting terminal 4 by a press-connecting tool 28 (or 29), a sheath of the wire 30 is cut by a U-shaped press-connecting blade 4A (or 4B) of the press-connecting terminal 4, so that a conductor of the wire contacts the press-connecting blade, and therefore the plurality of wires 30 are electrically connected together.

Also, when the plurality of hole closure pieces 7 are pressed upwardly by the hole closure pin 25 in the base 27, these hole closure pieces 7 are pressed and fused together to close the bottom of the press-connecting terminals 4.

The hole closure pin 25 can be moved upward and downward, for example, by a hydraulic cylinder or the like provided in the base 27. However, there is used the press-connecting step in which the press-connecting tools 28 and 29 press the wires 30 toward the press-connecting terminals 4, and hence also press the press-connecting connector 1, and therefore this press-connecting stroke is utilized.

More specifically, the hole closure pin 25 of a short length is formed upright on the upper surface of the base 27, and the press-connecting connector 1 is placed in a floating manner on the base 27, using the hole closure pin 25 as a guide. With this arrangement, simultaneously when the press-connecting tools 28 and 29 press the wires 30, the plurality of hole closure pieces 7 are pressed and fused together by the hole closure pin 25 to close the bottom of the press-connecting terminals 4. Therefore, the time required for the production process is reduced, and also the production cost can be reduced.

If this arrangement, in which the press-connecting connector 1 is placed in a floating manner on the base 27, using the hole closure pin 25 as a guide, is unstable, there can be additionally used known design device, such as compression springs provided on the base 27 at the opposite sides of the hole closure pin 25, respectively.

Then, when the press-connecting connector 1 is fed to and placed on a base 32 of a connecting portion-cutting device 31 as shown in FIG. 6, a cutter 33 is moved downward to cut the connecting portion 5, thus separating the press-connecting connector 1 from the linkage plate 3. At the same time, the plurality of hole closure pieces 7 are pressed upward and fused together by the hole closure pin 25 to close the bottom of the press-connecting terminals 4.

The hole closure pin 25 can be moved upward and downward, for example, by a hydraulic cylinder or the like provided in the base 32. However, there is used the cutting step in which the cutter 33 presses the press-connecting connector 1 downward so as to cut the connecting portion 5 connected to the press-connecting terminal 4, and therefore this pressing stroke can be used.

More specifically, the hole closure pin 25 of a short length is formed upright on the upper surface of the base 32, and the press-connecting connector 1 is placed in a floating manner on the base 32, using the hole closure pin 25 as a guide. With this arrangement, simultaneously when the cutter 33 cuts the connecting portion 5, the plurality of hole closure pieces 7 are pressed and fused together by the hole closure pin 25 to close the bottom of the press-connecting terminals 4. Therefore, the time required for the production process is reduced, and also the production cost can be reduced.

A cut surface of the connecting portion 5 is finally covered with a lock member 9 of a cover 8, and therefore there is not encountered a disadvantage that the connecting portion 5 contacts a metal portion of the car such as the car body, thereby causing short-circuiting.

The present invention is not to be limited to the above embodiments, and suitable modifications can be made. For example, in this embodiment, although the exposed portion has a circular shape, it may have a square shape. In the case of the square exposed portion, the hole closure piece 7 may be provided at each of four sides of this square exposed portion, or only two hole closure pieces may be provided at a pair of opposed sides.

As described above, in the press-connecting connector of the present invention, the plurality of hole closure pieces, molded by the fixing pin during the molding operation, are pressed toward the press-connecting terminals and fused together by the hole closure pin at the later step to close the exposed portion resulting from the trace of the fixing pin. Therefore, the reliability of the press-connecting connector is enhanced.

Where the closing of the exposed portion by the pressing of the hole closure pin is effected in the wire press-connecting step carried out after the insert-molding operation, it is not necessary to provide a separate step of pressing the hole closure pin, and therefore the efficiency of the operation is enhanced, and also the cost can be reduced.

Where the closing of the exposed portion by the pressing of the hole closure pin is effected in the connecting portion-cutting step carried out after the insert-molding operation, it is not necessary to provide a separate step of pressing the hole closure pin, and therefore the efficiency of the operation is enhanced, and also the cost can be reduced.

Where the hole closure pieces are molded by the hole closure piece-forming mold formed on the fixing pin, it is not necessary to provide a separate step of forming a closure portion for closing the exposed portion, and another separate step of pressing this closure portion, and therefore the cost can be reduced. And besides, since the exposed portion can be easily closed by pressing the hole closure pieces by the hole closure pin, the efficiency of the operation is enhanced.

The exposed portion, formed by the fixing pin, is closed by pressing and fusing the plurality of hole closure pieces, molded at the same time, together. Therefore, the highly-reliable press-connecting connector can be obtained.

What is claimed is:

1. A method of producing a press-connecting connector, said method comprising the steps of:

providing at least one press-connecting terminal connected to a linkage plate via a connecting portion;

positioning the press-connecting terminal in a mold with a fixing pin provided in the mold;

molding the press-connecting terminal in a non-electrically conductive material; and pressing hole closure pieces formed by the fixing pin so that an exposed portion of the terminal is closed.

2. The method of claim 1, wherein the closing of the exposed portion by the step of pressing is effected in a step of press-connecting a wire which is carried out after the step of molding.

3. The method of claim 1, wherein the closing of the exposed portion by the step of pressing is effected in a step of cutting the connecting portion which is carried out after the step of molding.

4. The method of claim 1, wherein the hole closure pieces are pressed by a hole closure pin in the step of pressing.

5. The method of claim 1, wherein the hole closure pieces are molded by a hole closure piece-forming mold formed on the fixing pin.

6. The method of claim 5, wherein the hole closure piece-forming mold of the fixing pin comprises a positioning stand for contacting with the press-connecting terminal, rising pieces and grooves between the positioning stand and the rising pieces.

7. The method of claim 1, wherein the step of pressing is effected before the non-electrically conductive material is sufficiently hardened.

8. The method of claim 7, wherein when the non-electrically conductive material is not hardened, the hole closure pieces are pressed and fused together to form an integral plate for closing a bottom portion of the press-connecting connector.

* * * * *